US005438627A

United States Patent [19]

Smith et al.

[11] Patent Number: 5,438,627

[45] Date of Patent: Aug. 1, 1995

[54] REACTANCE-MASS ACTUATOR

[75] Inventors: Thomas E. Smith, Madison; Gregory W. Terpay, Whippany; George G. Zipfel, Jr., Summit, all of N.J.

[73] Assignee: AT&T Corp., Murray Hill, N.J.

[21] Appl. No.: 997,744

[22] Filed: Dec. 30, 1992

[51] Int. Cl.[6] ..... H04R 25/00

[52] U.S. Cl. ..... 381/199; 381/201

[58] Field of Search ..... 381/199, 201, 202; 335/222; 310/15, 22, 23, 24, 51, 91

[56] References Cited

U.S. PATENT DOCUMENTS

| | | | |
|---|---|---|---|
| 4,609,784 | 9/1986 | Miller | 381/199 |
| 4,808,955 | 2/1989 | Godkin et al. | 335/222 |
| 4,912,343 | 3/1990 | Stuart | 310/14 |
| 5,062,140 | 10/1991 | Inanaga et al. | 381/199 |

*Primary Examiner*—Curtis Kuntz
*Assistant Examiner*—Sinh Tran
*Attorney, Agent, or Firm*—Charles E. Graves

[57] ABSTRACT

Disclosed is an electrodynamic moving coil actuator comprising one or more separate coils contained in interior spaces of a reactance mass. The coils are oriented in closely spaced parallel zones within the interior spaces. The spaces are formed and positioned to be outside of the static magnetic flux lines of the reactance mass. The static flux thus is substantially de-coupled from the dynamic magnetic field of the coil. Magnetic flux choke points are avoided, but at the same time, high volumetric efficiency is achieved. Each coil is attached to supports along its two long outer edges. The supports are connected to each other at their extremities by top and bottom plates which are connected by slide bars that also serve as tie rods. The reactance mass is mounted on the slide bars. The design is adapted to low frequency, high force applications such as active noise control automotive mufflers.

4 Claims, 7 Drawing Sheets

REACTANCE-MASS ACTUATOR

GOVERNMENT CONTRACT

This invention was made with Government support under Contract No. N00014-90-C-0258 awarded by the Department of the Navy. The government has certain rights in this invention.

FIELD OF THE INVENTION

This invention relates generally to moving coil and moving magnet actuators and, more specifically, to reaction-mass type actuators with substantially improved volumetric efficiency and magnetic field characteristics.

BACKGROUND OF THE INVENTION

In the field of noise or vibration control apparatus, the term "actuator" refers to a component which generates a controlled counter-vailing force and applies it to the vibrating medium, thus to reduce or eliminate the noise or vibration. Typically, actuators comprise a current-carrying coil contained in a magnetic field and driven by a current that varies with the magnitude and frequency of the vibrations to be reduced.

Depending on the specific application in which an actuator is employed, it sometimes is critical that the actuator's performance approach the maximum that can be achieved for a given actuator weight, volume, and peak force at a specified operating frequency. Today, however, the physical volume required by present actuator designs to deliver, for example, on the order of 1000 lb. peak force at a specified frequency often exceeds by far the available space for mounting the actuator. A need thus exists for an actuator with substantially improved output for a given physical volume.

A shortcoming of the magnetic circuit designs in present actuators is the existence of magnetic choke points where the magnetic flux concentrates. The resulting magnetic saturation, or choking, severely limits actuator performance potential. The performance limitations imposed by the existence of flux density concentrations particularly has impeded the development of volumetrically efficient actuators.

SUMMARY OF THE INVENTION

The invention is an electrodynamic moving coil actuator comprising at least one, but advantageously an arbitrarily large plurality of coils employed with a reaction mass consisting of permanent magnets and core material. The individual coils are closely interspersed with the magnetic field-producing components. The design is integrated to leave a minimum of unused interior space, thus making possible the use of a maximum amount of conductors per unit volume.

In one embodiment, the conductors of the coils are formed in an elongate, relatively slim coil arranged as a rectangular loop. The one or more conductor coils are oriented in closely spaced parallel planes within interior cavities of the reaction mass. The reactance mass constitutes a DC magnetic circuit that carries the static magnet return flux. The reactance mass may be constructed with silicon iron, for example.

The permanent magnets housed with the reaction mass are placed on both sides of each conductor coil. Each conductor coil is mechanically attached to supports along its two long outer edges. The supports in turn are rigidly connected to each other at their extremities by top and bottom plates, for example. The top and bottom plates are rigidly connected by slide bars which also act as tie rods. The reactance mass magnet structure is mounted on the slide bars, and is spring-loaded to be normally centered between the plates.

The ends of the coils extend beyond the confines of the reaction mass and the region of high magnetic flux. Because of this outwardly-extending coil structure and of the orientation of the coils to the permanent magnets, the magnetic field generated by the conductor coils when they are energized does not additively combine with the static flux field. The magnetic circuit carrying the static flux, therefore, is substantially de-coupled from the dynamic magnetic field of the coil. Thus, the two do not interfere with each other; and as a result, choke points are avoided. At the same time, however, very high volumetric efficiency is achieved.

When used as a reaction-mass "shaker," the actuator may be employed by affixing one of the plates to a vibrating surface. Alteratively, when used as a two-point actuator, the inventive structure may be employed by affixing one plate to a non-vibrating "ground" and the other to a vibrating body.

DETAILED DESCRIPTION OF AN ILLUSTRATIVE EMBODIMENT

Figure 1:
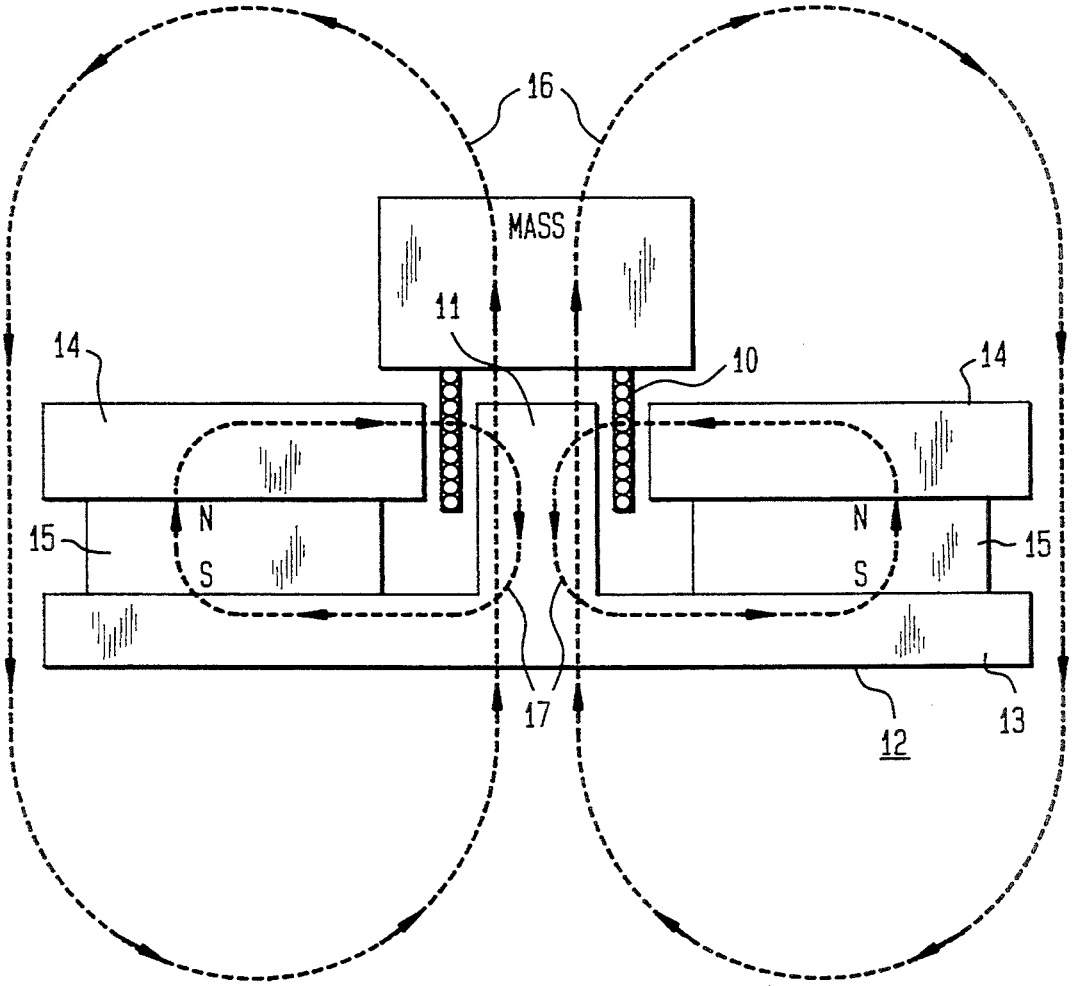
FIG. 1 (PRIOR ART)
FIG. 1 is a diagram depicting the interfering flux density lines of the static and dynamic magnetic fields of a typical prior art actuator.

As seen in FIG. 1, the magnetic flux density lines of a typical prior art reaction mass actuator can interfere because of the configuration of the coils and their associated dynamic AC-driven magnetic flux, with respect to the configuration of the reactance mass with its associated permanent magnets. A moving coil denoted 10 connected to a mass is disposed around a rising center portion 11 of a lower reactance mass 12 with a base 13. Concentrically around the coil 10 is a ring-shaped upper reactance mass 14. A ring-shaped permanent magnet 15 is disposed around the riser 11 and between the lower and upper masses 12, 14. The conventional direction of the dynamic flux density lines generated by the coil 10, illustrated by the numeral 16, is seen to be traveling vertically within the interior central space of the coil 10 through the riser portion 11, thence out and beyond the reactance structure of elements 12, 13, 14, 15 and finally back into the riser 11, forming the familiar donut-surface shaped magnetic field. The direction of the static flux density lines of the reactance structure 12, 13, 14, 15 travel within the reactance mass for the most pan, in a path denoted by the flux line numbered 17. The path of flux travel includes the riser 11. Thus, the static and dynamic flux interfere with one another—in this prior art design, specifically in the region of the riser 11. Further, the interference or coupling of the two magnetic fields limits the magnitude of both fields (since magnetic saturation will occur in the vicinity of the riser 11 ) and thus also the output and performance efficiency of the actuator.

Figure 2:
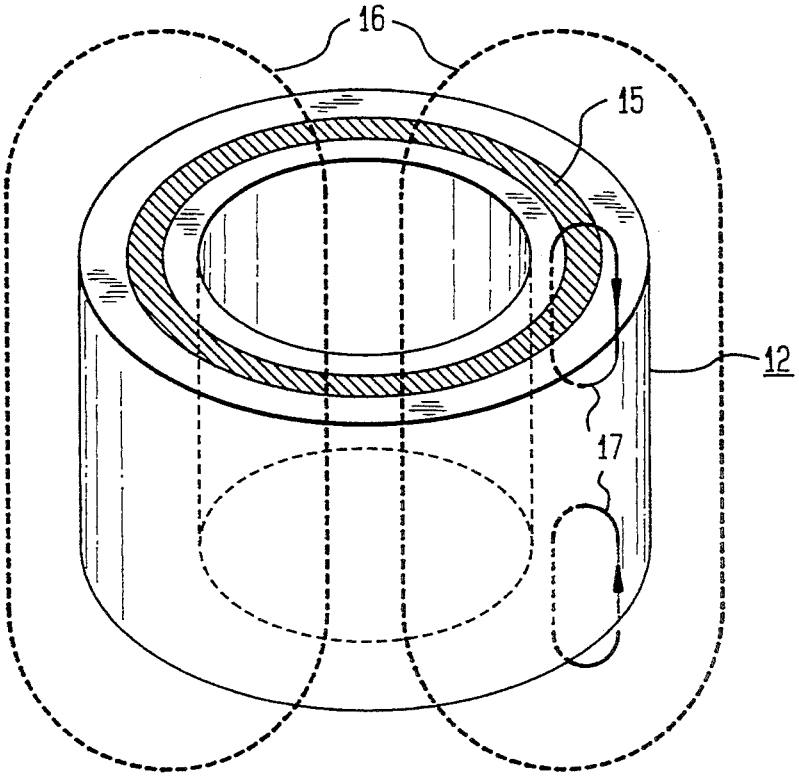
FIG. 2 is a diagram illustrating the principle of non-interfering flux density lines between the static and dynamic magnetic fields of the present invention.

One principal of the present invention is illustrated by reference to FIG. 2, wherein numeric callouts corresponding to structural components in FIG. 1 are again used. By confining the static magnetic flux lines 17 to the reactance mass and permanent magnet assembly 12, and providing a path for the dynamic flux lines 16 to travel within the volume of the assembly 12, the two flux fields do not come in contact with each other and thus do not cause choking and saturation. This aspect of the instant invention is illustrated in the structure now to be described.

Figure 3A:
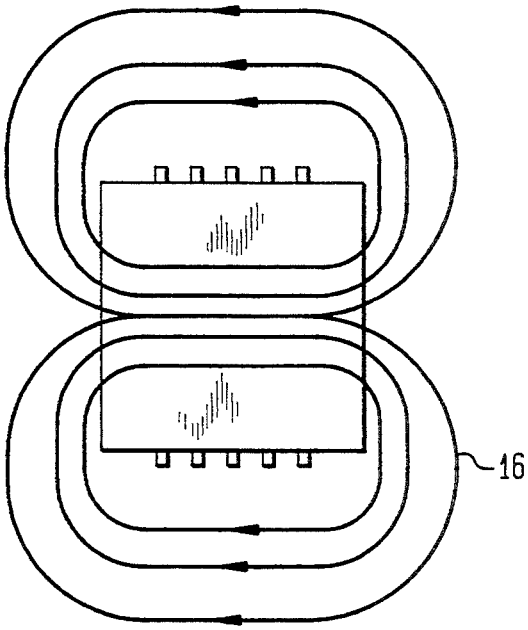
FIGS. 3A–3C are schematic diagram views of a specific actuator structure containing the invention, further showing the non-interfering magnetic flux density lines.
Figure 3B:
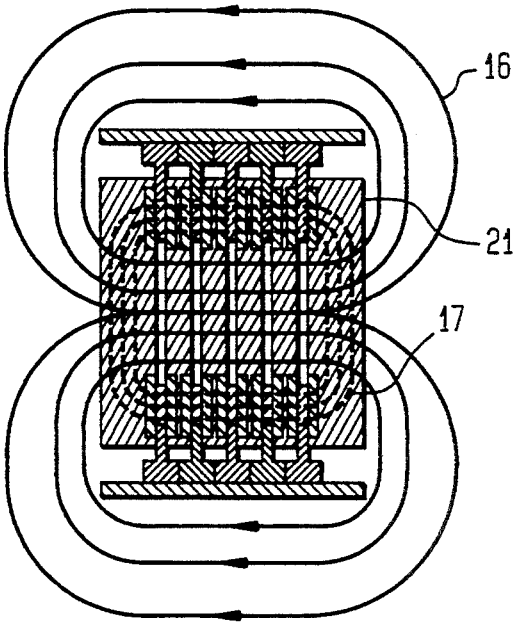
Figure 3C:
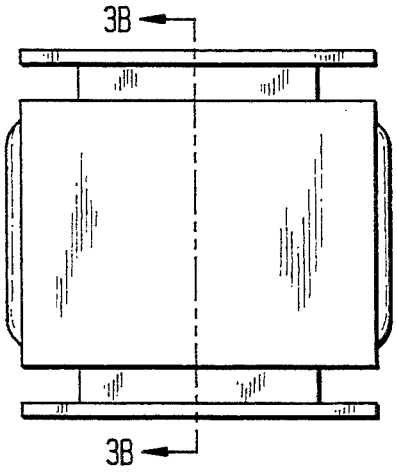
Figure 4:
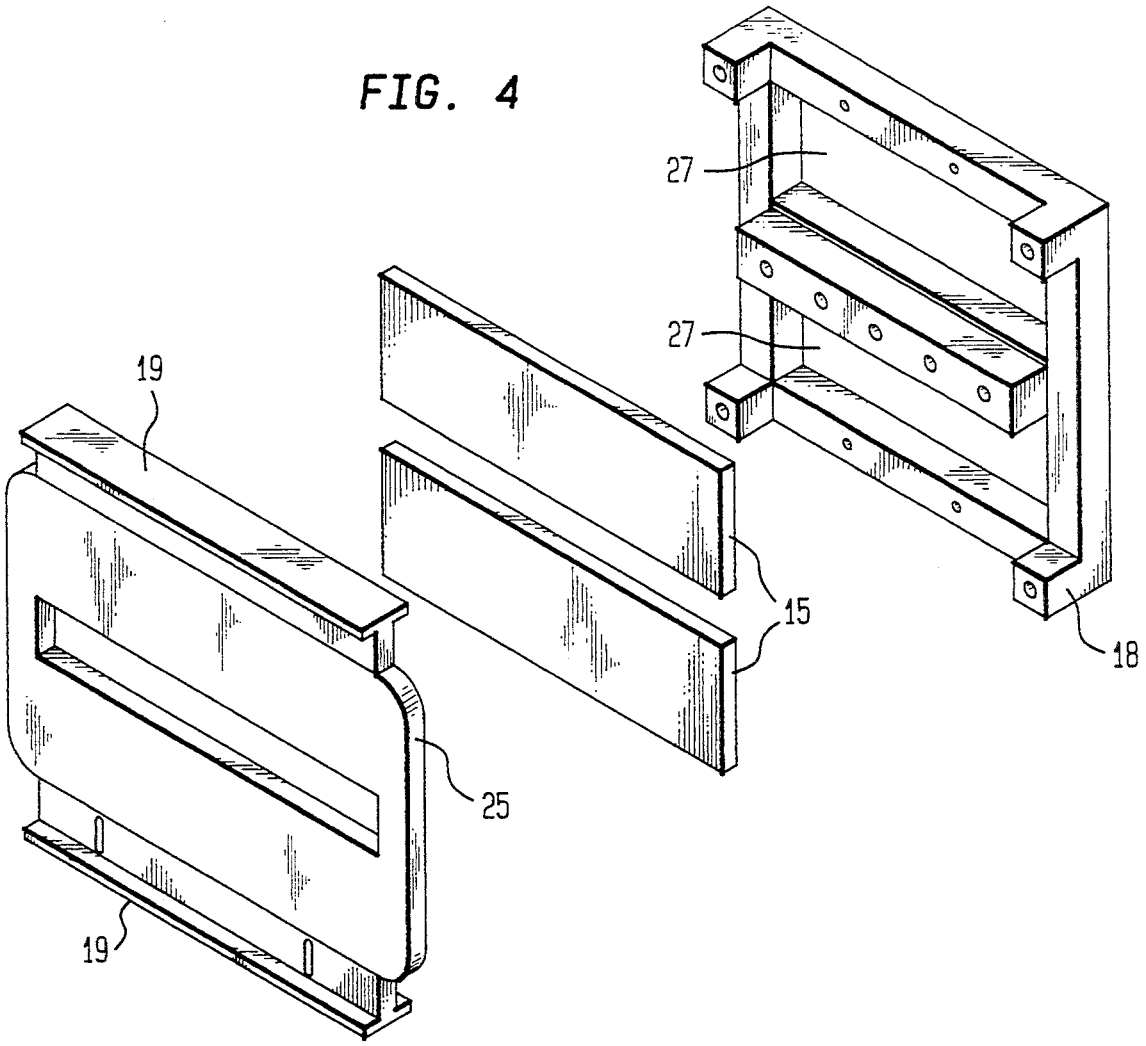
FIG. 4 is a schematic perspective diagram illustrating the permanent magnet and coil mountings.

Referring to the specific embodiment of the invention seen in FIGS. 3 and 4, static magnetic flux density lines 17 are contained within an overall reactance mass 21. The mass 21 is constructed to include internal space, shown in Section A—A of FIG. 3 and more clearly in FIG. 6, as slots 23. In accordance with one aspect of the invention, seen best in FIG. 7, the coils 22 are housed in this internal space within the reactance mass. The dynamic magnetic flux density lines 16, generated by the coils 22 do not intersect with the static flux lines 17.

In addition to accomplishing a highly advantageous de-coupling of the static and dynamic flux fields, locating coils 22 in close quarters in internal spaces of the reactance mass 21 makes for a compact, volume-efficient design. One advantageous coil configuration achieving this result, illustrated in FIG. 4, is an elongate, relatively slim rectangular wire loop 25. Several such loops 25 may be employed in a given actuator.

Permanent magnets 15 of the reactance mass are held in a support member 18 which constitutes part of the mass. In this embodiment, as seen in FIG. 4, two elongate magnets are held in cavities 27, two such cavities being formed on either side of each support 18. The next-adjacent magnet support member 18 serves the top-left and bottom-left sides of the same loop 25. When the supports, permanent magnets and loops are assembled as shown in FIG. 6, the upper magnets are positioned adjacent to the top-right elongate sides of a loop 25, and the lower magnets are positioned along the bottom-right elongate side of the same loop 25. As can be seen from FIGS. 5 and 6, a succession of loops 25 may be disposed in close side-by-side spacing within the slots 23 of reactance mass 21. In this structural arrangement, the static and dynamic flux forces are spatially separated so as not to interfere.

Each loop 25 is mechanically attached to upper and lower coil supports 19 along the outer edges of the loop. The supports 19 may be affixed to top and bottom plates 20, 24. The plates 20, 24 may be rigidly connected by four slide bars 26 shown in FIG. 5. The slide bars 26 serve as a slide on which to mount the reactance mass 21 for limited movement. Springs 28 spring-load the mass 21 to a normally centered neutral position between the plates 20, 24.

Figure 5A:
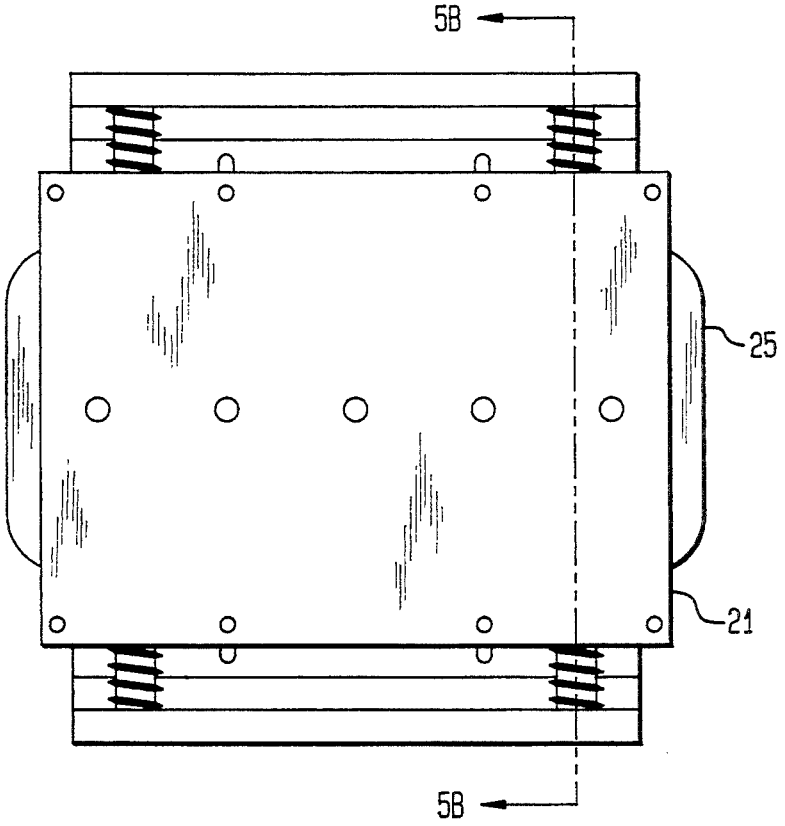
FIGS. 5A–5B are side view and front view in section, showing an assembly of several coil members with supports and end-plates disposed within the reaction mass and its permanent magnets.
Figure 5B:
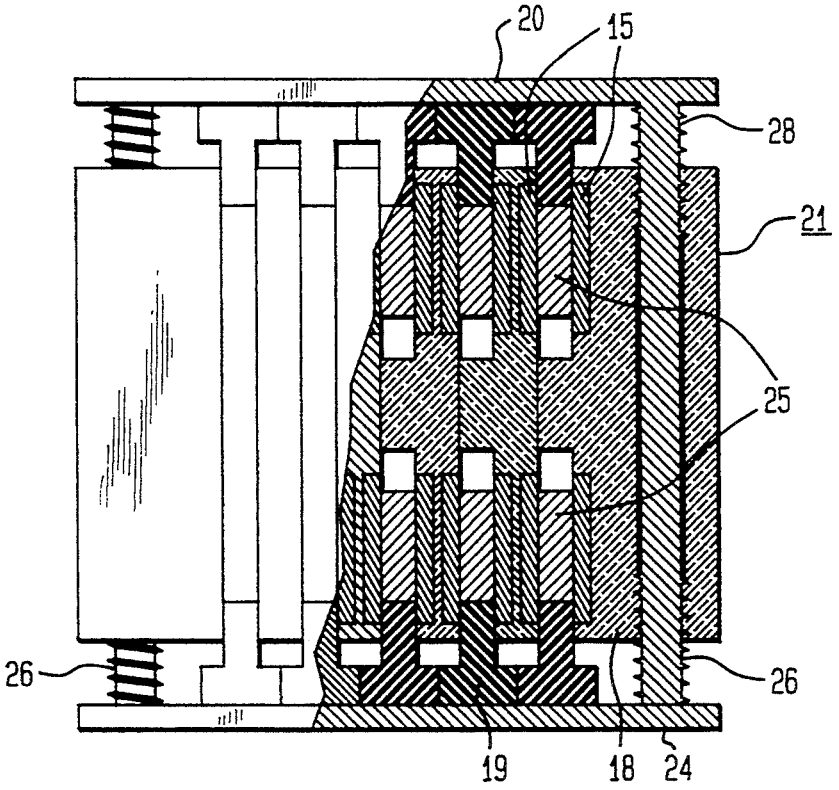
Figure 6:
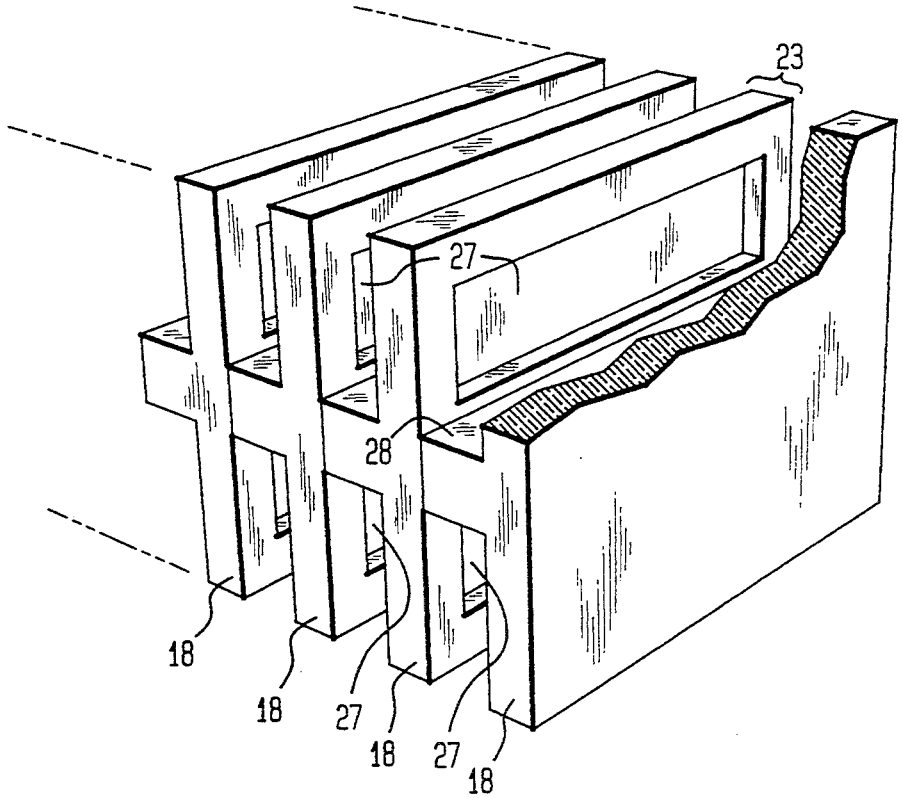
FIG. 6 is a perspective view in partial section illustrating the assembly and structure of the core iron which mounts the permanent magnets.
Figure 7:
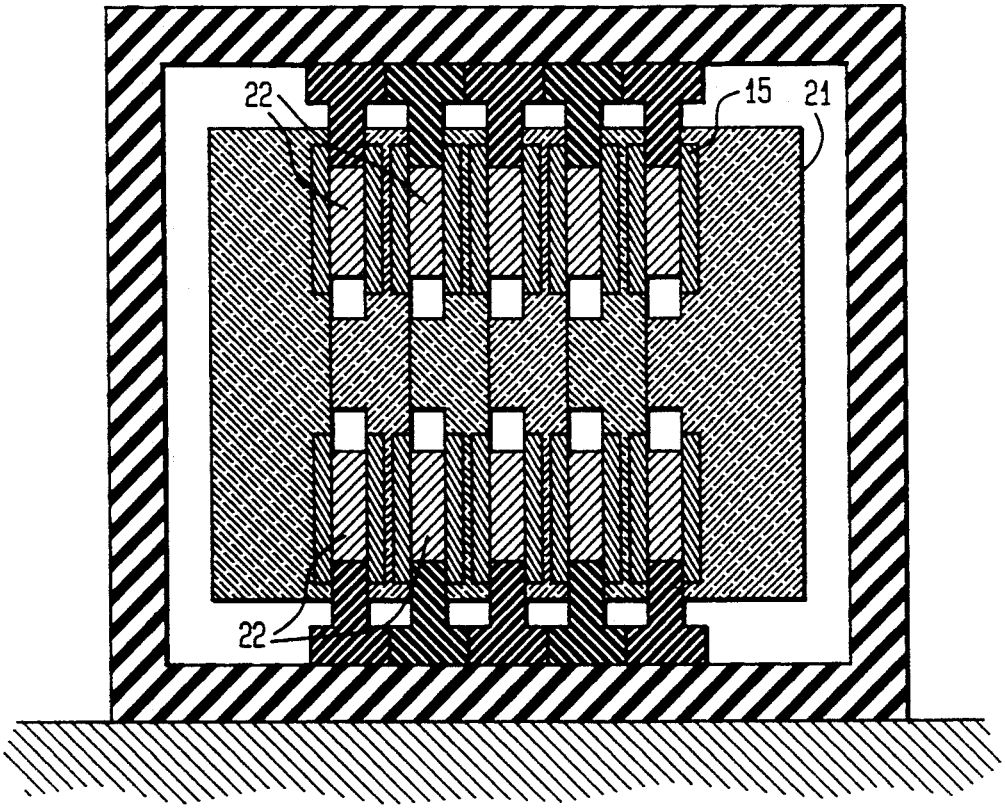
FIG. 7 is a front view in section of the actuator design concept, illustrating the core iron dc magnetic circuit and reactance mass.

The loop-around ends of the loops 25 extend beyond the ends of the reaction mass 21 as is seen in the side view of FIG. 5, and thus beyond the region of high static magnetic flux. This expedient contributes to avoiding additively combining the two flux fields. An assembly of a plurality of magnet supports 18 is shown in FIG. 6. Each support 18 is formed as a vertical plate with magnet—containing cavities 27. Each plate includes a central shelf extending from the mid area of one side of the plate. Coil loops 25 may be installed one at a time over each successive shelf extension. By thus stacking a multiplicity of supports 18 together with their respective coil loops, any desired number of coils may be used to drive the actuator. The completed stack may be held together with bolts (not shown).

The linearity of the actuator is determined by the uniformity of the magnetic field, which will vary as the conductor coils move. The invention is particularly well-suited to applications requiring generation of relatively low frequency, high force outputs. An operating frequency requirement of, for example, 100 Hz is readily accommodated by the instant invention. High force applications requiring operating frequencies up to about 1000 Hz may also be well-served by the invention. The maximum practical operating frequency of the design of this embodiment will depend on the force requirement, resonances in the actuator structure, and other factors.

Figure 8:
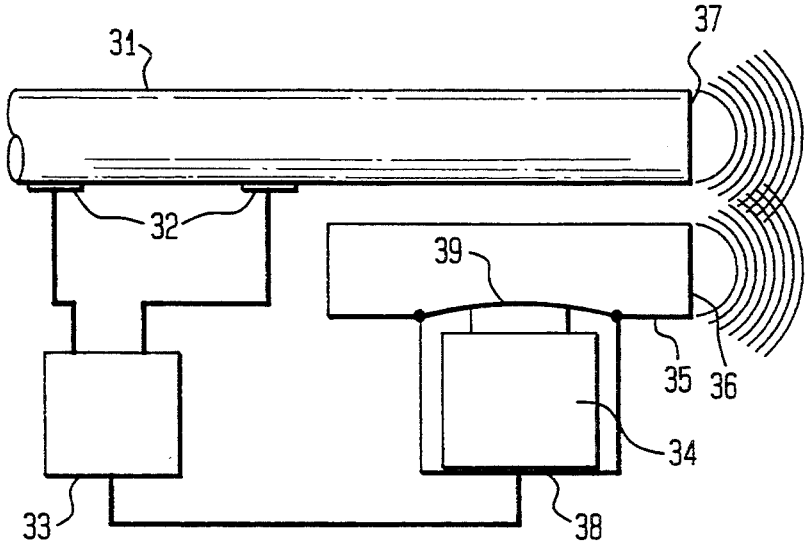
FIG. 8 is a schematic block diagram broadly illustrating the use of the inventive actuator in an exemplary active noise control system.

FIG. 8 exemplifies use of the invention on an active noise control automotive muffler. An auto exhaust pipe 31 emitting exhaust noise is fitted with pressure or equivalent sensors 32 along an exterior surface. The pressure variations within the exhaust system typically include characteristic amplitude peaks occurring as a complex function of system temperature, engine speed and load. The sensors 32 continuously monitor the exhaust pressure, supplying amplitude information to a control unit 33. As peak low frequency energy is detected, control unit 33 generates a countervailing electrical analog signal for driving an actuator 34 constructed in accordance with the invention.

Advantageously, actuator 34 is mounted within an internal cavity of a closed chamber 35. An outlet 36 of the chamber 35 is disposed closely adjacent to the outlet 37 of exhaust pipe 31. The lower plate of actuator 34 is affixed to the interior base 38 of the internal cavity. The upper plate of actuator 34 is connected to a diaphragm 39 which forms a portion of one side of the chamber 36 that seals off the cavity containing actuator 34.

The driver signal to actuator 34 has a frequency and magnitude determined by processes programmed into control unit 33. The acoustic counter—noise signals generated by diaphragm 39 subtractively combine with the exhaust energy in the vicinity of the outlets 36, 37 to reduce the overall muffler noise.

We claim:

1. A moving coil actuator comprising:

coil means including elongate rectangular loops of wire having top and bottom elongate sections, said coil means generating a dynamic magnetic flux field;

a reactance mass including:

an iron core having discrete internal cavities for housing said coil means;

permanent magnet means contained within said iron core for creating a static magnetic flux field;

said reactance mass and said coil means configured to spatially place said static and said dynamic flux fields in non-interfering relation;

upper and lower coil mounting means for rigidly holding said coil means as a unitary coil structure;

means connected between said upper and said lower coil mounting means for slidably mounting said reactance mass to enable limited relative movement of said mass with respect to said coil means and said coil mounting means; and means in said reactance mass for mounting said permanent magnet means on either side of the top and bottom elongate sections of each said wire loop.

2. The actuator in accordance with claim 1, wherein said loops of wire have end portions, and said end portions of each said loop extend out from and beyond said reaction mass.

3. The actuator in accordance with claim 2, wherein said iron core comprises:

magnet support structures each comprising a plate with magnet-containing cavities, each plate comprising a central shelf extending from the mid area of one side of the plate, said support structures being assembled side-to-side with each said shelf butting against the adjacent said plate, and a volume within said reactance mass above and below each respective said shelf containing one of said elongate rectangular loops of wire of said coil means.

4. The actuator in accordance with claims 2, 3, or 1 in combination with:

an internal combustion engine exhaust pipe;

pressure sensors disposed along an exterior surface of said pipe; for monitoring pressure variations within said pipe;

a control unit;

means for supplying the monitored pressure variations to said control unit;

said control unit in response to predetermined exhaust signal peak amplitudes generating countervailing electrical analog signals for driving said actuator to create an acoustic signal to reduce the output noise level of said exhaust pipe.

* * * * *